United States Patent [19]

Burkstrand et al.

[11] Patent Number: 4,807,719

[45] Date of Patent: Feb. 28, 1989

[54] SCAFFOLDING ASCENT APPARATUS

[75] Inventors: George W. Burkstrand, Columbia Heights; Lowell E. Burkstrand, Braham, both of Minn.

[73] Assignee: Side Step Inc., Columbia Heights, Minn.

[21] Appl. No.: 221,777

[22] Filed: Jul. 20, 1988

[51] Int. Cl.[4] ..... E06C 5/00

[52] U.S. Cl. ..... 182/15; 182/97; 182/118

[58] Field of Search ..... 182/15, 17, 97, 152, 182/118, 179

[56] References Cited

U.S. PATENT DOCUMENTS

| | | | |
|---|---|---|---|
| 1,701,951 | 2/1929 | Holt | 182/15 |
| 2,630,961 | 3/1953 | Burg | 182/15 |
| 2,899,010 | 8/1959 | Ledgerwood | 182/15 |
| 3,020,972 | 2/1962 | Hockett | 182/15 |
| 3,504,768 | 4/1970 | Boyd | 182/152 |
| 3,997,024 | 12/1976 | Fredricks | 182/17 |

*Primary Examiner*—Reinaldo P. Machado
*Attorney, Agent, or Firm*—Lawrence M. Nawrocki

[57] ABSTRACT

Apparatus for ascending scaffolding (10). The apparatus includes a ladder (24) having an inner upright (26) which is pivotally mounted with respect to an upright (20) of an end frame (12) of the scaffolding (10). The ladder (24) is disposed for pivoting between a retracted position, wherein the latter (24) overlies the end frame (12) of the scaffolding (10) to which it is attached, and an extended position, wherein the ladder (24) is pivoted, typically, 180° relative to the retracted position.

8 Claims, 2 Drawing Sheets

SCAFFOLDING ASCENT APPARATUS

TECHNICAL FIELD

The present invention deals broadly with the field of apparatus for enabling construction or maintenance workers, or the like, to maintain themselves in an elevated position proximate a building or other structure on which they are working. More narrowly, the invention deals with the field of scaffolding. The invention focuses upon structures for allowing the person mounting the scaffolding to easily and safely climb to a desired height. The invention encompasses a uniquely designed ladder which not, only provides the means to mount the scaffold, but also inhibits tipping of the scaffolding as the worker is climbing to the desired level.

BACKGROUND OF THE INVENTION

Various types of scaffolding are known in the prior art. Large scaffolding which can extend up, for example, a number of floors of a building which is being constructed of repaired is one type that is employed. Such scaffolding is, typically, anchored in some manner to the building or structure which is being ascended. Anchoring of this nature is necessary because of the weight of the scaffolding segments and the catastrophic results that would be occasioned should the scaffold fall.

Obviously, scaffolding of this nature has drawbacks. While it enables workers to perform tasks and functions at significant heights, once it is in place, it becomes substantially immobile. If the scaffolding needs to be transferred to a different location—even one closing proximate its original location—significant time must be invested in accomplishing the transfer.

In view of these drawbacks, lighter and more mobile scaffolding is employed wherever possible. If a job involves, for example, painting at a height of approximately six to ten feet, a lighter more portable type of scaffolding can be utilized. This type of scaffold typically includes a pair of end frames which are maintained in position opposite one another by a plank-like member having a working surface, which member is disposed generally horizontally to interconnect the end frames. Typically, such a working surface can be disposed at a plurality of heights so that the maximum height which can be reached by a worker standing thereon can be varied.

Each end framed is frequently constructed in the form of a ladder. That is, it includes two uprights interconnected by a plurality of rungs. When the scaffolding is assembled with the working surface member interconnecting the end frames, the uprights of the end frames are disposed generally vertically and the rungs are spaced vertically from one another, typically at equal distances.

Frequently, the lower end of each of the four uprights is provided with a caster. A structure so constituted is mobile, and, once it is finished being used in a particular location, it can quickly and easily be moved to another location.

Because of applications to which scaffolding of this type is put, it typically involves being moved frequently. For example, when the scaffolding is being used to paint a high ceiling, once the painter completes a segment accessible with the scaffolding in a particular location, the scaffolding must be moved to another location generally adjacent that it previously occupied.

Depending upon the size of the room, the scaffolding might be moved numerous times before the ceiling's painting is completed.

As can be seen, scaffolding of this lighter more mobile type has significant advantages over that for employment for larger projects, as previously described. There are, however, trade-offs. For example, because of its lighter weight and greater mobility, it tends to be less stable. This drawback is further aggravated by circumstances in view of the construction typically provided to the end frames. Because of their ladder-like appearance, workers utilizing the scaffold are encouraged to mount the scaffolding by climbing up the rungs of one or the other of the end frames.

Workers can minimize the hazards involved by climbing to the top of the end frame and down the other side (that is, the inside of the scaffolding) to climb onto the working surface. This becomes relatively inconvenient, however, when the working surface is only at a relatively small percentage of the distance up the end frames.

In order to save time and effort, workers typically climb to the height at which the working surface is positioned and swing outwardly around the end frame being climbed in order to get onto the working surface. When this occurs, depending upon the weight of the material of which the scaffolding is made, the center of gravity can be transferred outside the base of the scaffold. When this occurs, the scaffolding will tip over.

Certainly, the scaffolding could be made safer by making the end frames and the plank-like member defining the working surface of very heavy materials. By taking such action, however, the advantages of lighter weight and greater mobility normally inherent in a smaller scaffold of this type are negated.

The present invention is improved means for ascending a light-weight mobile scaffold of this type. It is directed to solving the problems of the prior art and providing desirable characteristics without negating the advantages of such scaffolding.

SUMMARY OF THE INVENTION

The present invention is a device that can be employed by workers ascending scaffolding. The invention is intended to be used with scaffolding which has at least one end frame for supporting a plank-like member having a working surface, with the working surface in a generally horizontal orientation. Typically, two such end frames are employed to support the plank-like member at opposite ends thereof. The device includes a ladder and means for mounting the ladder to an end frame of the scaffolding. The invention includes means for allowing pivoting of the ladder about a generally vertically oriented axis between retracted and extended positions. The retracted position of the ladder is one wherein the ladder overlies the end frame to which it is mounted and defines a plane generally parallel to one defined by the end frame. The extended position is one wherein the ladder is pivoted away from the retracted position more than 90° but less than 270°. That is, the extended position is one wherein the ladder defines either an oblique or straight angle with respect to the position it occupies when retracted.

The working surface of the scaffolding is more accessible to a worker ascending the ladder when it is swung out into its extended position than is the working surface to the worker who ascends the end frame. Even more importantly, however, by pivoting the ladder into an extended position more than 90° from the retracted position, the base of the scaffolding is expanded in a direction of its typically most narrow dimension. That is, the base of the scaffolding, in a direction generally perpendicular to the axis of elongation of a plank-like member, becomes increased in size.

By pivoting the ladder 180°, the greatest stability is afforded. In some instances, however, it might be desirable to pivot the ladder beyond 180° so that the working surface is more accessible to a person climbing the ladder. If the ladder was pivoted, for example, 225° from its retracted position, a degree of desired stability might still be provided, while increasing the measure of accessibility of the working surface.

In order to facilitate pivoting of the ladder, means can be provided for biasing it upwardly so that a lower extremity thereof is normally not in engagement with the surface on which the scaffold is positioned. In the preferred embodiment, the ladder can be provided with a member (typically, one of its uprights) which carries an element defining a downwardly facing shoulder. The end frame to which the ladder is mounted can be provided with means for defining an upwardly facing shoulder, and a spring can be interposed between the shoulders to normally lift the ladder so that the lower extremeties of its uprights do not touch the floor surface.

As one will recognize in view of this disclosure, an upright of the end frame to which the ladder is to be attached can be provided with a fitting, or fittings, for mounting the ladder. In order to preclude the need for conversion of existing scaffolds, however, the invention can include an elongated standard for carrying the fittings. The standard can be affixed to an end frame to which the ladder is to be mounted. The ladder is, in turn, attached to the standard and, thereby, to the scaffolding. No special reconfiguration of any of the standard portions of the scaffolding, thereby, need be done.

If desired, the invention can incorporate means for locking the ladder in a retracted position. Means can also be provided for locking the ladder in one or more extended positions.

The present invention is thus an improved apparatus for providing means for ascending a scaffolding easily and safely. More specific features of the invention and advantages obtained in view of those features will become apparent with reference to the DETAILED DESCRIPTION OF THE INVENTION, appended claims, and accompanying drawings.

DETAILED DESCRIPTION OF THE INVENTION

Figure 1:
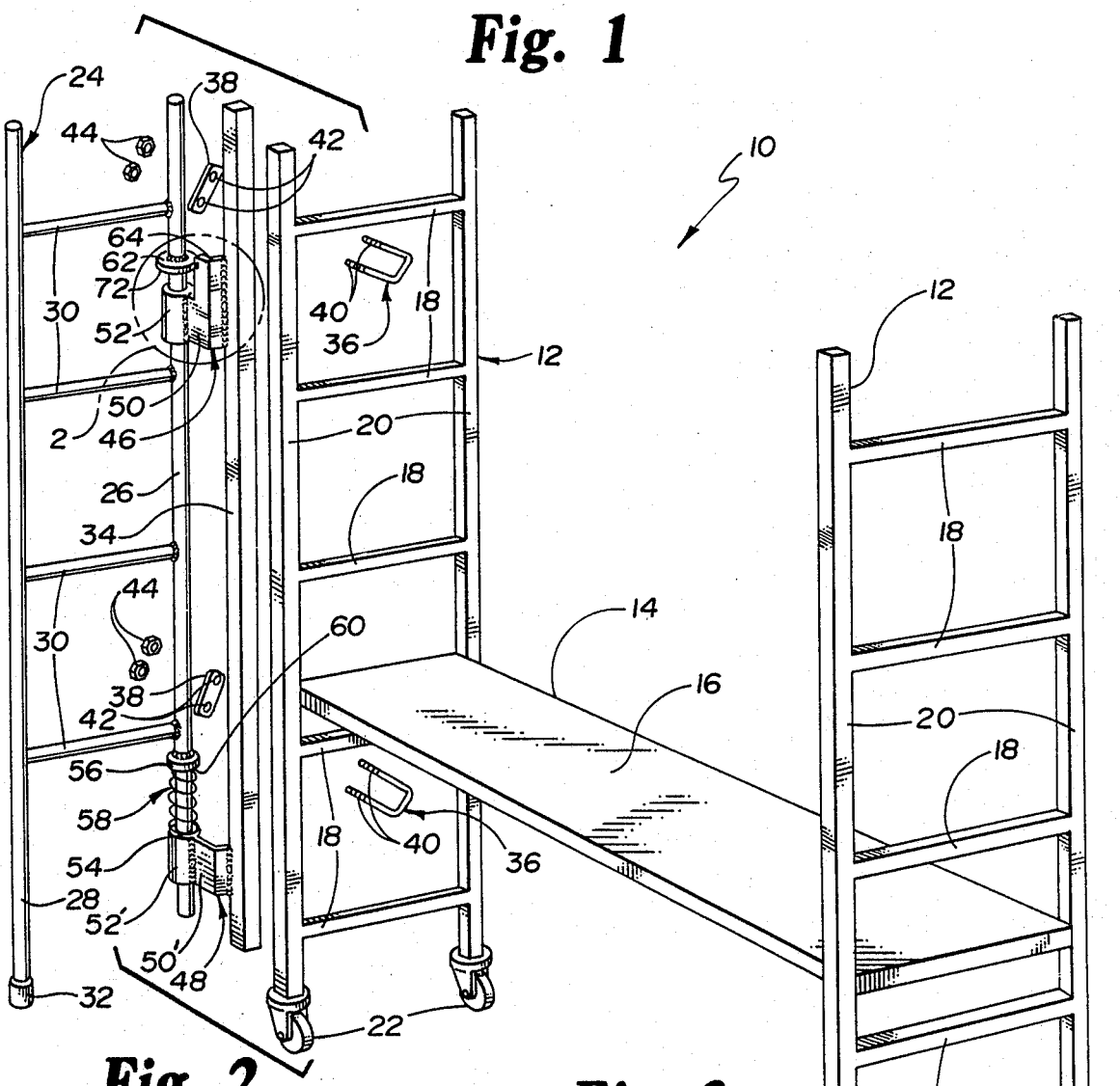
FIG. 1 is an exploded perspective view illustrating the present invention with a scaffolding structure to which it can be attached.

Referring now to the drawings wherein like reference numerals denote like elements throughout the several views, FIG. 1 illustrates the present invention in proximity to a typical scaffolding 10 with which it is intended to be used. The scaffolding 10 includes a pair of end frames 12 which, being in their intended positions of use, are disposed to define generally vertical planes. The end frames 12 are maintained in these dispositions by a plank-like member 14, having a working surface 16, which member 14 interconnects the end frames 12. Typically, the plank-like member can be disposed at various heights along the end frames 12. Means (not shown) are provided for accomplishing affixation.

Each end frame 12 is shown as having a plurality of rungs 18 spacing and interconnecting two uprights 20. The rungs 18 are spaced along the uprights 20 at substantially equal distances and can provide footing to a worker climbing the scaffold 10.

Each upright 20 of the two end frames 12 is shown as having a caster 22 mounted at the lower extremity thereof. The scaffold 10 is, thereby, provided with four-point mobile support.

While the scaffold 10 illustrated in the drawing figures is one that employs a pair of end frames 12, it will be understood that the invention lends itself to employment with a scaffolding having only one end frame. For example, in some situations, one end of the plank-like member 14 could be mounted to a fixed wall, the other end being attached at a single end frame.

FIG. 1 illustrates a ladder 24 of the present invention in a position about to be secured to one of the end frames 12 of the scaffold 10. The ladder 24 includes a pair of uprights 26, 28 having a plurality of interconnecting rungs 30.

It will be noted that the two uprights 26, 28 are shown as being different in length. An inner upright 26 is shorter and is illustrated as having an exposed lower extremity. An outer upright 28 is longer and is shown as having a protective cap 32 at its lower extremity, since this upright, when the ladder 24 is being ascended, engages the floor. If the scaffolding 10 is being used in a room having a tile or linoleum covering, the protective cap 32 functions to minimize the likelihood of damage being occasioned upon that tile or linoleum.

FIG. 1 illustrates a standard 34 having a length generally similar to that of the inner upright 26 of the ladder 24. The standard 34 is illustrated as being formed of square stock. It will be understood, however, that the employment of such material is not exclusive.

The invention contemplates that this standard 34 would be secured to an end frame 12 of the scaffolding 10 by means of a pair of U-bolts 36. Each U-bolt 36 would be dimensioned so that it could be fitted obliquely about both one of the rungs 18 of the end frame 12 to which the ladder 24 is to be secured, and the standard 34. A plate 38 would then be fitted over the tines 40 of the U-bolt 36 by passing the tines 40 through corresponding apertures 42 in the plate 38. Nuts 44 are thereafter, secured to the threaded tines 40 and tightened down to secure the standard 34 at a desired axial position relative to the end frame 12.

As one may garner in view of this disclosure, the relative axial location of the standard 34 with respect to the end frame 12 can be varied by loosening the nuts 44 on the ends of the U-bolt tines 40 and sliding the standard 34 relative to the end frame 12. This feature affords certain advantages that will be discussed hereinafter.

The standard 34 is shown as being provided with a pair of fittings 46, 48, one at an upper location and one at a lower location. Each fitting 46, 48 is provided with an L-bracket portion 50, 50' and a sleeve 52, 52' welded to the corresponding L-bracket portion 50, 50'. The fittings 46, 48 are, in turn, welded to the upright standard 34. It will be understood that welding is not an exclusive method of mating the various components together, but, in view of the nature of the materials of which the components are typically made, welding is appropriate in most instances.

It is envisioned that the inner upright 26 of the ladder 24 would be made of round stock of a diameter similar to the inside diameter of circular channels within the sleeves 52, 52'. The ladder 24 would be affixed to the standard 34 by passing the inner upright 26 through these channels. Because of the round stock employed for the inner upright 26, the ladder 24 would be free to pivot relative to the standard 34.

The lower fitting 48 is shown as having an L-bracket 50' with an axial dimension the same as that of the corresponding sleeve 52'. An upper edge 54 of the sleeve 52' defines an upwardly facing shoulder. The inner upright 26 of the ladder 24 is provided with an annular disc 56 at a position therealong so that it would be normally spaced from the upwardly facing shoulder 54 defined by the sleeve 52'. The disc 56 would, typically, be welded to the upright 26.

A coil spring 58 is interposed between the sleeve 52' of the lower fitting 48 and the annular disc 56, a lower end of the spring 58 engaging the upwardly facing shoulder 54 defined by the sleeve 52', and the upper end of the spring 58 engaging a downwardly facing shoulder 60 defined by the disc 56. The spring 58 functions to bias the ladder 24 in what would be an upwardly direction along the standard 34. The standard 34 can, thereby, be secured to an end frame 12 of the scaffold 10 at an axial location therealong so that, in view of the biasing of the coil spring 58, the lower extremity of the outer upright 28 of the ladder 24 will normally be elevated with respect to the floor on which the scaffold 10 is positioned. The distance the ladder 24 is biased, however, will be sufficiently small so that, while the ladder 24 is in an extended position (that illustrated in FIG. 1), and a user of the scaffolding 10 wishes to ascend to the working surface 16 of the plank-like member 14, he can step on the ladder 24, and the ladder 24 will descend into engagement with the floor.

In view of the biasing effected by the coil spring 58, the ladder 24 will not, other than when it is in use, be in engagement with the floor. This protection, in addition to the protection afforded by the end cap 32 at the lower extremity of the outer upright 28 of the ladder 24, will tend to preclude damaging effects upon the floor of the room in which the scaffolding is positioned.

While the axial dimensions of the L-bracket 50' and sleeve 52' of the lower fitting 48 are substantially the same, such is not true of the upper fitting 46. In the case of the upper fitting 46, the sleeve portion 52 of the fitting 46 has a smaller axial dimension than does the L-bracket 50.

Figure 2:
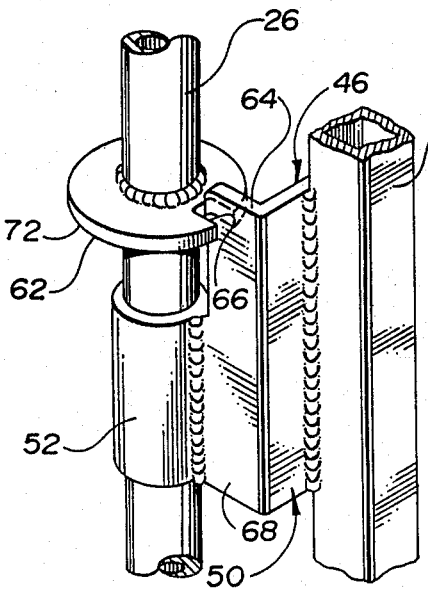
FIG. 2 is an enlarged fragmentary perspective detailed view illustrating structure whereby the ladder of the invention can be locked in an extended position.

The inner upright 26 of the ladder 24 is provided with a second annular disc 62 fixedly positioned along the upright 26 at an upper location thereon. The disc 62 is posited at an axial location on the upright 26 so that, when the ladder 24 is in its normal position resting on the coil spring 58, the disc 62 will tend to be located relative to the upper edge 64 of the L-bracket 50 of the upper fitting 46 generally as seen in FIG. 2. As illustrated in that figure, this upper disc 62 is provided with a slit 66 formed at an angular position therein so that, when the ladder 24 is pivoted to its extended position, the slit 66 will be received over the upper edge 64 of that portion 68 of the L-bracket 50 of the fitting 46 to which the sleeve 52 is welded. As a result, the ladder 24, when it is in is extended position, will be locked in that position, even if the ladder 24 has not been mounted, unless the ladder 24 is lifted relative to the fittings 46, 48.

Figure 3:
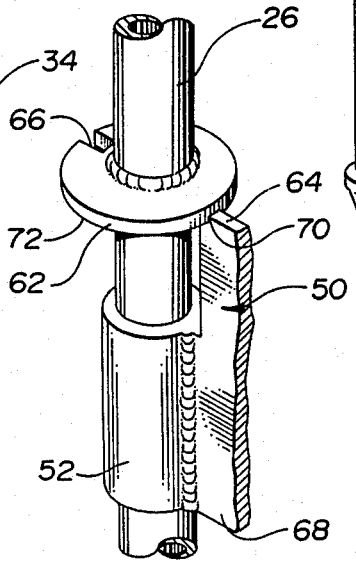
FIG. 3 is a view similar to that FIG. 2 illustrating structure whereby the ladder can be locked in a retracted position.

FIG. 3 illustrates the ladder 24 in a position pivoted 180° from the orientation illustrated in FIG. 2. In this orientation, the upper disc 62 is seated on the upper edge 64 of that portion 68 of the L-bracket 50 of the fitting 46 to which the sleeve 52 is welded. The disc 62, however, is provided with a notch 70 on the underside 72 thereof. The notch 70 does not extend through the full axial dimension of the disc 62, and, as a result, the seating of the disc 62 on the portion 68 of the L-bracket 50 will occur as described. The receipt of the upper edge 64 of the portion 68 of the L-bracket 50 within the notch 70, however, will preclude pivoting of the ladder 24 from this position unless the ladder 24 is elevated relative to the fittings 46, 48.

Figure 4:
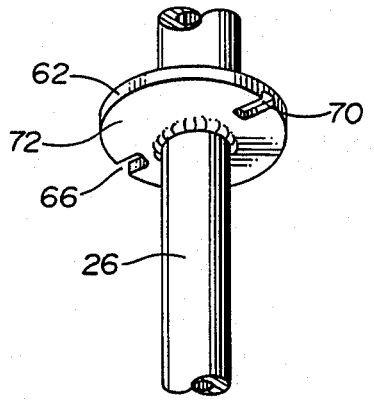
FIG. 4 is an under-side perspective view of the locking disk.
Figure 5:
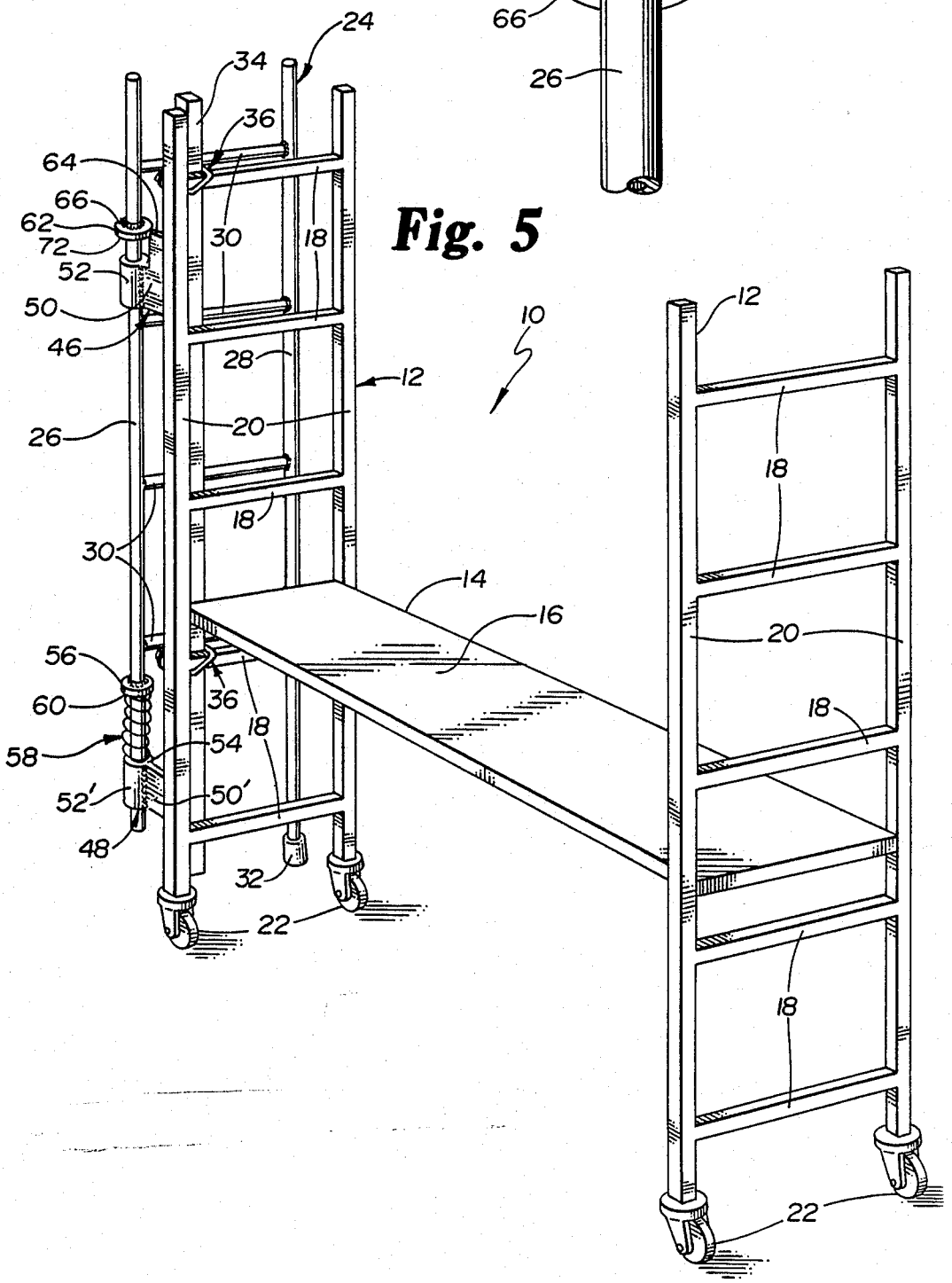
FIG. 5 is a perspective view illustrating the ladder as mounted to a scaffolding structure and locked in the retracted position.

The angular positioning of the slit 66 and notch 70 in the disc 62 function to define the retracted and extended positions of the ladder 24. With their positing as seen in FIGS. 3 and 4, the ladder 24 will nave an extended position as seen in FIG. 1 and a retracted position as seen in FIG. 5. It will be understood, however, that the angle from the notch 70 to the slit 66 could reasonably occupy a position within an arc between 135° to 225°, if desired. If appropriate, in fact, a plurality of slits could be provided to define a corresponding plurality of extended positions of the ladder 24.

When the scaffold 10 is in a work location, the ladder 24 would, typically, be maintained in its retracted position. When a worker desires to ascend the scaffold 10 onto the working surface 16 of the plank-like member 14, the ladder 24 need only be raised relative to the standard 34 so that the portion 68 of the L-bracket 50 of the upper fitting 46 to which the sleeve 52 is welded is moved relatively downward with respect to the upper disc 62 to a point at which the portion 68 of the L-bracket 50 would be withdrawn from the notch 70. The ladder 24 would then be free to be rotated from the position illustrated in FIG. 5 to that illustrated in FIG. 1.

During this rotation, the person reorienting the ladder 24 need not maintain any upper lifting force upon the ladder 24. The upper edge 64 of the portion 68 of the L-bracket 50 to which the sleeve 52 is welded can serve as a bearing on which the upper disc 62 will ride.

The ladder 24 can be continued to be rotated in a direction wherein the notch 70 moves angularly away from the upper edge 64 of the L-bracket 50 until the slit 66 becomes registered with that portion 68 of the L-bracket 50. Once that registration occurs, the ladder 24 will drop downwardly with the L-bracket portion 68 received within the slit 66.

Because of the biasing effect of the coil spring 58, the ladder 24 will still be maintained so that the lower extremity of the outer upright 28 is still out of engagement with the floor. Still, the ladder 24 will be locked against further pivoting movement.

When the person steps on the lowest of the rungs 30 of the ladder 24, the biasing of the coil spring 58 will be overcome. The lower extremity of the outer upright 28 will, at that time, come into engagement with the floor as the coil spring 58 compresses.

The worker then continues to ascend the ladder 24 until he is at a height where it is convenient to transfer to the working surface 16 of the plank-like member 14. Once on that working surface 16, the ladder 24 can, if desired, be returned to its retracted position. This is accomplished in a manner similar to that for rotating the ladder 24 from the retracted to the extended position. The direction of pivoting of the ladder 24, however, is in a reciprocal direction. It will be understood, however, that it might well be deemed appropriate to maintain the ladder 24 in the extended position during working on the scaffolding 10 in order to afford a greater degree of stability.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. Apparatus for ascending scaffolding, including at least two end frames for supporting a member having a working surface therebetween with the working surface in a generally horizontal orientation and extending along an axis aligning the end frames, wherein said end frames define generally vertically oriented planes, comprising:

(a) a ladder; and (b) means for mounting said ladder to one of the end frames for pivoting about a generally vertically oriented axis between a retracted position, wherein said ladder overlies the end frame to which it is mounted and defines a plane substantially parallel to that defined by the end frame to which said ladder is mounted, and an extended position, wherein said ladder is pivoted at an angle of more than 90° and less than 270° from said retracted position.

2. Apparatus in accordance with claim 1 wherein said mounting means comprises means for pivoting said ladder between said retracted position and an extended position angularly spaced from said retracted position by between 135° and 225°.

3. Apparatus in accordance with claim 2 wherein said mounting means comprises means for pivoting said ladder between said retracted position and an extended position angularly spaced from said retracted position by substantially 180°.

4. Apparatus in accordance with claim 1 wherein said ladder has a lower extremity, and further comprising means for biasing said ladder upward, wherein, as said ladder is pivoted between said retracted position and said extended position, said lower extremity is out of engagement with the surface on which the scaffolding is positioned.

5. Apparatus in accordance with claim 4 wherein said ladder further comprises a generally vertically extending member carrying an element defining a downwardly facing shoulder, said biasing means comprising:

(a) means, carried by the end frame to which said ladder is mounted, defining an upwardly facing shoulder; and (b) resilient spring means interposed between said downwardly and said upwardly facing shoulders.

6. Apparatus in accordance with claim 1 wherein said ladder comprises a pair of uprights interconnected by a plurality of rungs, at least one of said uprights being formed from round stock, said mounting means comprising upper and lower sleeves, attached to a generally vertically extending element of the end frame to which said ladder is mounted, receiving said round stock upright therewithin.

7. Apparatus in accordance with claim 1 further comprising means for locking said ladder in said extended position.

8. Apparatus in accordance with claim 1 further comprising means for locking said ladder in said retracted position.

* * * * *